US009446432B2

(12) United States Patent
Dickinson et al.

(10) Patent No.: US 9,446,432 B2
(45) Date of Patent: Sep. 20, 2016

(54) VIBRATORY APPARATUS WITH TRANSPORT AND ASSEMBLY METHOD

(71) Applicant: General Kinematics Corporation, Crystal Lake, IL (US)

(72) Inventors: Eric Dickinson, Crystal Lake, IL (US); William Gerald Lichtenberger, Crystal Lake, IL (US)

(73) Assignee: General Kinematics Corporation, Crystal Lake, IL (US)

( * ) Notice: Subject to any disclaimer, the term of this patent is extended or adjusted under 35 U.S.C. 154(b) by 0 days.

(21) Appl. No.: 14/612,602

(22) Filed: Feb. 3, 2015

(65) Prior Publication Data

US 2015/0224541 A1 Aug. 13, 2015

Related U.S. Application Data

(60) Provisional application No. 61/938,130, filed on Feb. 10, 2014.

(51) Int. Cl.

| | |
|---|---|
| ***B07B 1/34*** | (2006.01) |
| ***B07B 1/46*** | (2006.01) |
| ***B07B 1/36*** | (2006.01) |
| ***B07B 1/00*** | (2006.01) |
| ***B07B 1/42*** | (2006.01) |

(52) U.S. Cl.

CPC ..... *B07B 1/46* (2013.01); *B07B 1/005* (2013.01); *B07B 1/36* (2013.01); *B07B 1/42* (2013.01); *B07B 1/4618* (2013.01); *B07B 1/4645* (2013.01); *B07B 2201/04* (2013.01); *Y10T 29/49826* (2015.01); *Y10T 29/49947* (2015.01)

(58) Field of Classification Search

CPC ..... B07B 1/005; B07B 1/36; B07B 1/42; B07B 1/46; B07B 1/4618

USPC ..... 209/311, 313, 325

See application file for complete search history.

(56) References Cited

U.S. PATENT DOCUMENTS 2,713,415 A * 7/1955 Wurzbach ..... B65G 27/00 198/763
2003/0201237 A1* 10/2003 Grichar ..... B01D 33/0376 210/785

FOREIGN PATENT DOCUMENTS

| | | | |
|---|---|---|---|
| AU | WO 8402290 A1 * | 6/1984 | ..... B07B 1/4645 |
| WO | WO 84/02290 | 6/1984 | |
| WO | WO 97/31725 | 9/1997 | |
| ZA | WO 9731725 A1 * | 9/1997 | ..... B07B 1/42 |

OTHER PUBLICATIONS

International Search Report and Written Opinion, counterpart International Appl. No. PCT/US2015/014239, dated Apr. 29, 2015.

* cited by examiner

*Primary Examiner* — Terrell Matthews
(74) *Attorney, Agent, or Firm* — Cook Alex Ltd.

(57) ABSTRACT

A vibratory apparatus includes a first sidewall, a second sidewall and at least one pair of mated interior walls, the first sidewall, the second sidewall and the at least one pair of mated interior walls depending longitudinally between an inlet end and an outlet end. The at least one pair of mated interior walls is disposed laterally between the first and second sidewalls. At least one deck depends between the first and second sidewalls, and is divided into longitudinally depending sections by the at least one pair of mated interior walls. The apparatus also includes an exciter coupled to the at least one deck.

11 Claims, 4 Drawing Sheets

VIBRATORY APPARATUS WITH TRANSPORT AND ASSEMBLY METHOD

BACKGROUND

This patent is directed to a vibratory apparatus and a method for transporting and assembling a vibratory apparatus, and, in particular, to a vibratory screening apparatus and a method for transporting and assembling the same.

For many years, mining operations have used brute force vibratory screening units to separate the materials generated by upstream crushing and/or grinding operations so that these materials may be further processed downstream to extract metal from ore. A brute force, or direct drive, screening unit is one in which the exciter is secured or bolted to the trough (or driven mass). Such units housed in large processing buildings or plants have been used to process, for example, 1000 tons/hour of rock to separate out the desired amount of metal.

Coincident with the recent introduction and commercialization of large capacity grinding mills, lower quality ore bodies are being processed. This results in considerably more material being processed to obtain the same amount of metal from higher quality ore bodies. As a consequence, these direct drive units have had to handle significantly more material, with processing rates doubling or tripling as a result.

To handle the increased processing demands, the industry has seen a shift to larger and larger units. Where a direct drive unit screening unit with a 2 meter width may have been used in the past, a direct drive unit with a 4 meter width is used now to accommodate the increased loading. Increases in size have associated and related increases in the power requirement for the screening unit.

In the alternative, certain mines have shifted to use of vibratory screening units featuring a two-mass exciter unit. Two-mass exciter units have the advantage of responding positively to loading. That is as loading increases, the screening unit will provide an increase, rather than a reduction, in stroke. As a consequence, such screening units have a lower power requirement than a direct drive unit.

The size of even two-mass vibratory screening units is considerable, however. Further, fabrication of the screening unit on site is not desirable, such that the unit is typically fabricated at one location and transported for use in a second location. The first and second locations typically considerably distant as a matter of geography, with hundreds or thousands of miles separating the fabrication location from the installation location.

SUMMARY

According to one aspect of the present disclosure, a vibratory apparatus includes a first sidewall, a second sidewall and at least one pair of mated interior walls, the first sidewall, the second sidewall and the at least one pair of mated interior walls depending longitudinally between an inlet end and an outlet end. The at least one pair of mated interior walls is disposed laterally between the first and second sidewalls. At least one deck depends between the first and second sidewalls, and is divided into longitudinally depending sections by the at least one pair of mated interior walls. The apparatus also includes an exciter coupled to the at least one deck.

According to another aspect of the present disclosure, a method of transporting and assembling a vibratory apparatus includes fabricating at a fabrication site a first sidewall, a second sidewall and at least one pair of mated interior walls, the first sidewall, the second sidewall and the at least one pair of mated interior walls depending longitudinally between an inlet end and an outlet end, the at least one pair of mated interior walls disposed laterally between the first and second sidewalls when the apparatus is assembled, and at least one deck depending between the first and second sidewalls when the apparatus is assembled, and divided into longitudinally depending sections by the at least one pair of mated interior walls. The method also includes fabricating at a fabrication site an exciter to be coupled to the at least one deck. The method further includes transporting the apparatus in at least three sections to an installation site, the first section comprising the first sidewall, one of the at least one pair of mated interior walls, and the longitudinally depending section of the at least one deck between the first sidewall and the one of the at least one pair of mated interior walls, the second section comprising the second sidewall, one of the at least one pair of mated interior walls, and the longitudinally depending section of the at least one deck between the second sidewall and the one of the at least one pair of mated interior walls, and the third section comprising the exciter. In addition, the method includes attaching the pair of mated interior walls together at the installation site, and attaching the exciter to the first and second sections at the installation site.

BRIEF DESCRIPTION OF THE DRAWINGS

It is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION OF VARIOUS EMBODIMENTS

Figure 1:
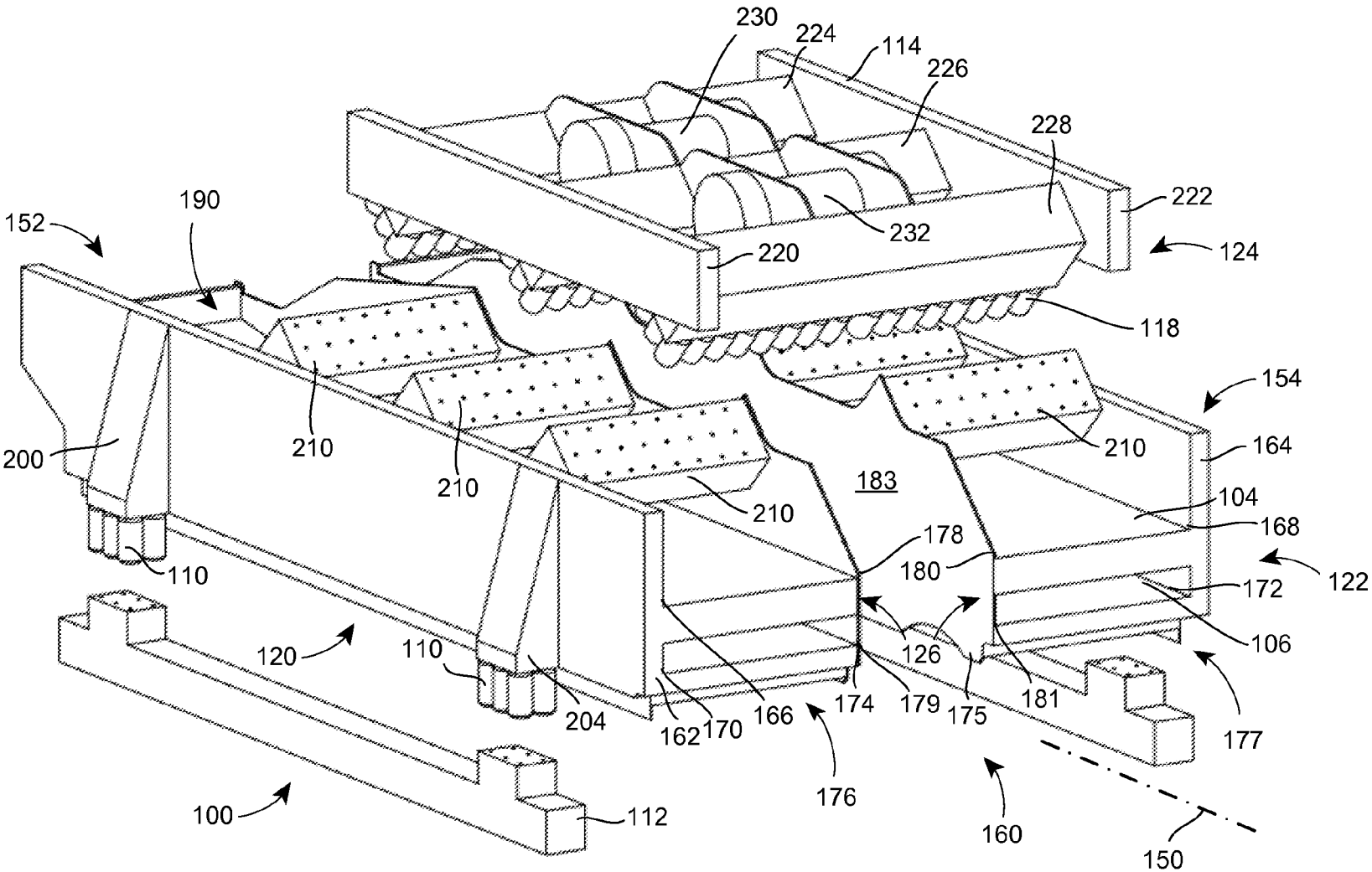
FIG. 1 is an exploded, perspective view taken from an outlet end of a vibratory apparatus, such as a vibratory screening apparatus, according to an embodiment of the present disclosure.
Figure 2:
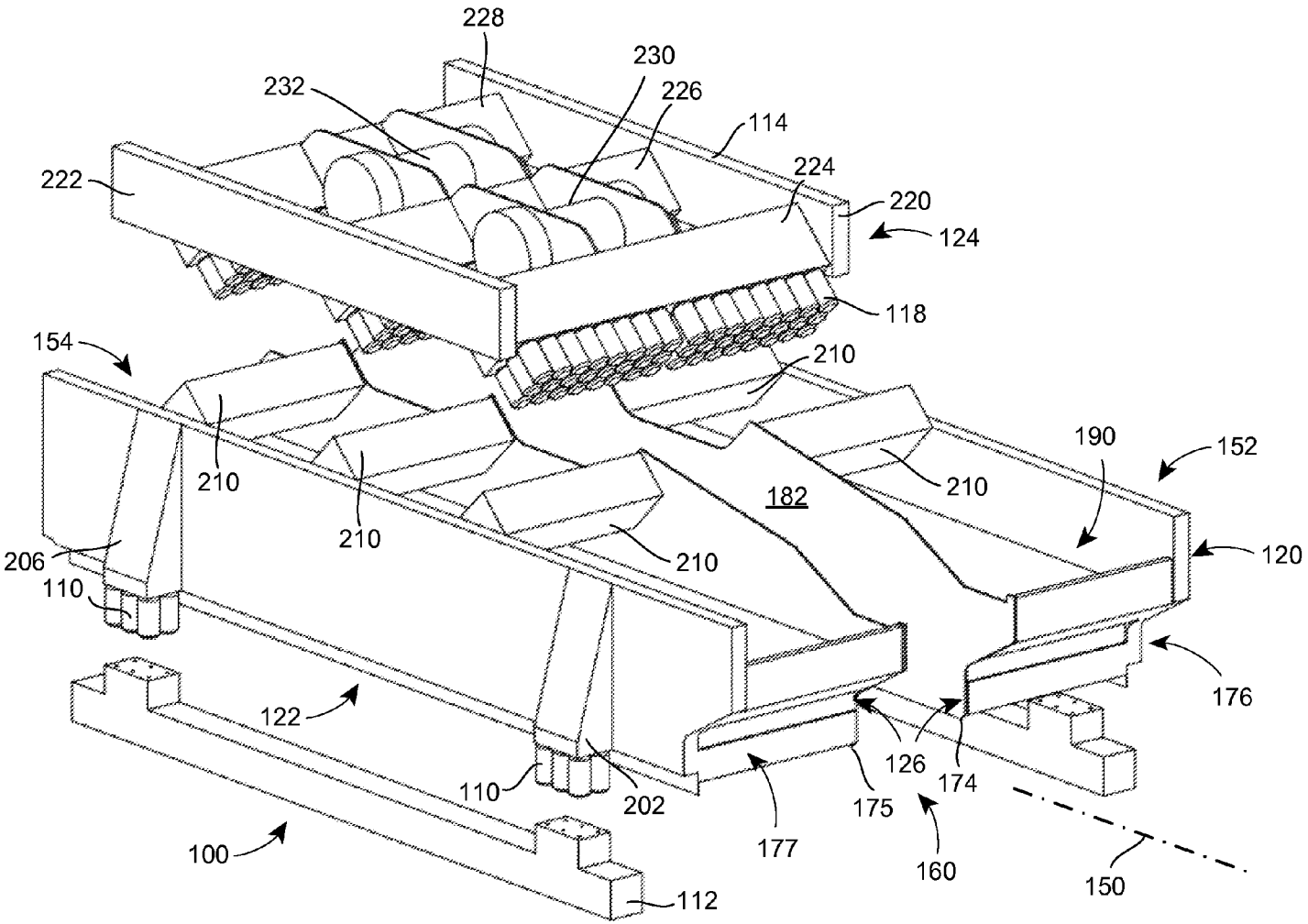
FIG. 2 is an exploded, perspective view taken from an inlet end of the vibratory apparatus of FIG. 1.
Figure 3:
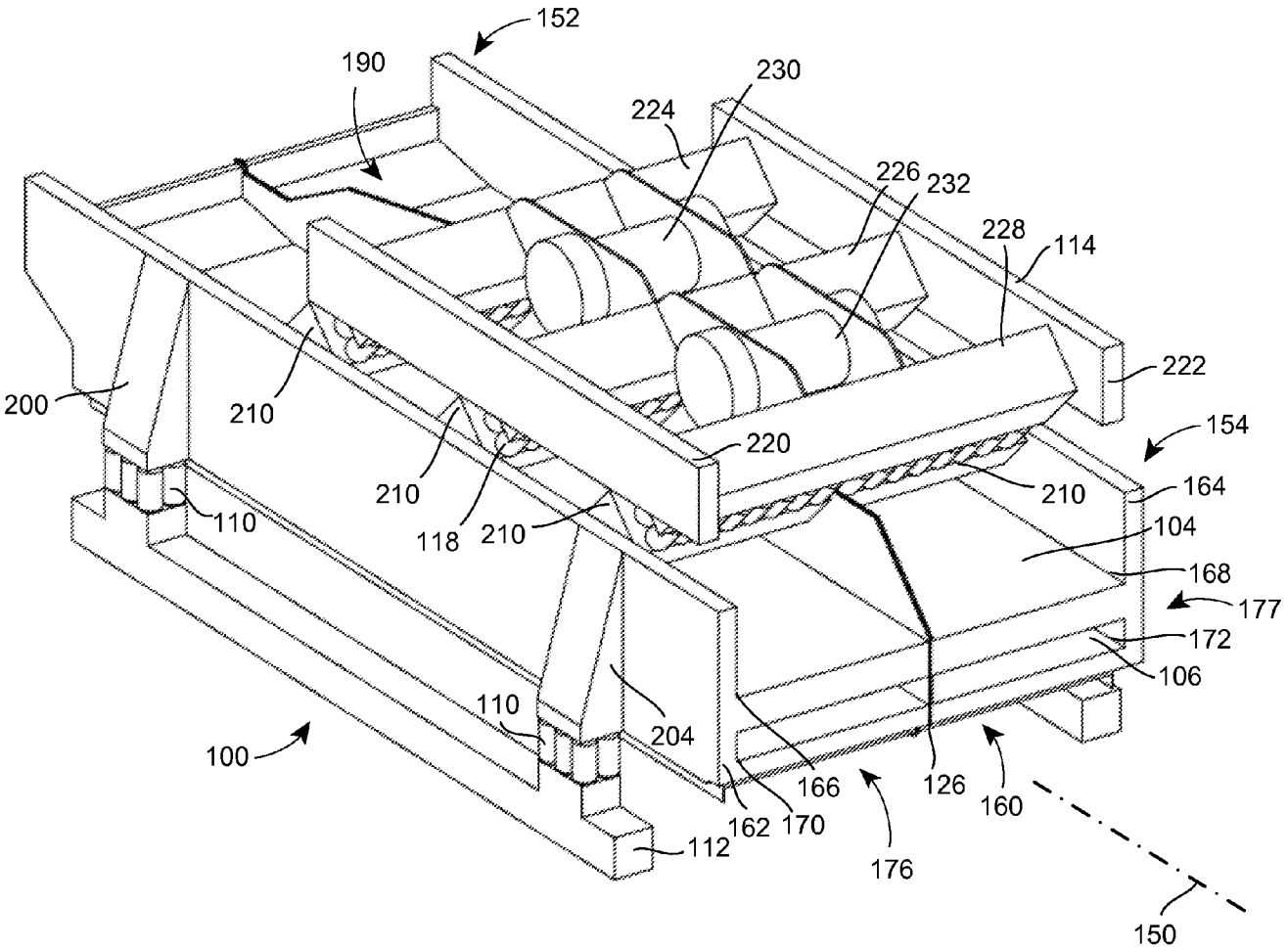
FIG. 3 is an assembled, perspective view taken from an outlet end of the vibratory apparatus of FIG. 1.

FIGS. 1-3 illustrate a vibratory apparatus 100, in the form of a vibratory screening apparatus, screener, or screen. The embodiment of the apparatus 100 according to the present disclosure is not limited for use only with vibratory screeners or screens, but has been illustrated in such a context for purposes of explaining aspects of the apparatus 100. FIGS. 1 and 2 illustrate the apparatus 100 as disassembled for transport, while FIG. 3 illustrates the apparatus fully assembled.

The vibratory screen 100 is a two-mass, sub-resonant frequency design. The screen 100 includes one or more decks 104, 106 (as best seen in FIGS. 1 and 3) supported by resilient members (e.g., coil springs, also referred to as isolation springs) 110 on a frame 112. While two decks 104, 106 are illustrated, the screen 100 might also have only one deck or more than two decks. The frame 112 is disposed on a foundation, which may be the ground story of a building or which may be an upper story of such a structure; in fact, vibratory screening units are typically mounted at the uppermost levels of the buildings in a mining processing plant. An exciter 114 is coupled to the decks 104, 106 through an assembly of resilient members (e.g., coil springs) 118 (see FIGS. 1-3) and optional links (not shown).

The exciter 114, or first mass, is used to drive the decks 104, 106, or second mass, and thus the screen 100 may be referred to as a two-mass unit. One advantage of using a two-mass configuration is that the two-mass configuration responds positively to loading. That is, as the loading increases, the screen 100 will actually provide an increase in stroke, rather than a reduction in stroke (or dampening). As such, a two-mass screen of lower power requirements may be used in place of a direct-drive or brute force unit to process a similar loading, or a two-mass screen of similar power requirements may be used to process a much larger load.

As suggested above, the resilient members or isolation springs 110 act to isolate the screen 100 from the foundation. That is, the resilient members 110 act to minimize the transmission of the dynamic forces generated during operation of the screen 100 to the frame 112 and the underlying foundation.

To facilitate fabrication and installation, the apparatus 100 is divided into at least three separate sections 120, 122, 124. As illustrated, the first and second sections 120, 122 each include part of the decks 104, 106, while the third section 124 includes the exciter 114. In particular, each deck 104, 106 is divided into the first and second sections 120, 122 by at least one pair of mated interior walls 126. As illustrated, a single pair of mated interior walls 126 divides each deck 104, 106 into two separate sections; if more than one pair of mated interior walls 126 was includes, each deck could be divided into three, four, or more separate sections.

By including the at least one pair of mated interior walls 126, each of the sections 120, 122, 124 may be fabricated at a fabrication site, transported in at least three sections 120, 122, 124 to an installation site, and then attached together at the fabrication site to assembly the apparatus 100. In particular, the pair of mated interior walls 126 is attached together at the installation site, and then the third section including the exciter 114 is attached to the subassembly of the first and second sections 120, 122. According to certain embodiments, the pair of mated interior walls 126 may be reversibly attached at the fabrication site (by fasteners such as bolts, for example) so that the apparatus 100 may be tested and calibrated, the pair of mated interior walls 126 may be detached at the fabrication site so that the apparatus may be transported in at least three sections to the installation site, and then the pair of mated interior walls 126 may be irreversibly attached at the installation site (by welding, for example).

Having thus described the apparatus 100 in general terms, the details of the apparatus 100 are provided below, returning first to FIGS. 1 and 3.

The apparatus 100, as illustrated, is symmetrical about a longitudinal axis 150 that extends from an inlet end 152 to an outlet end 154. As a consequence, the side view taken from the left of the axis 150 in FIG. 1 is a mirror image of the side view taken from the right of the axis 150 in FIG. 1. For purposes of convenience only, the side view taken from the left of the axis 150 in FIG. 1 may be referred to as the left side view, and the side view taken from the right of the axis 150 in FIG. 1 may be referred to as the right side view.

The apparatus 100 has a trough 160 that includes the one or more decks 104, 106 and side walls 162, 164, the side walls 162, 164 disposed parallel to the longitudinal axis 150 (within certain tolerances). The deck 104 (which may be referred to as an upper deck) may be joined at a first edge 166 to the side wall 162, and at a second edge 168 to the side wall 164. Similarly, the deck 106 (which may be referred to as a lower deck) may be joined at a first edge 170 to the side wall 162, and at a second edge 172 to the side wall 164. In particular, the edges 166, 170 may be attached to an inner surface of the side wall 162, while the edges 168, 172 may be attached to an inner surface of the side wall 164.

The apparatus also includes the at least one pair of mated interior walls 126, as referenced above. According to the illustrated embodiment, a single pair 126 of interior walls 174, 175 is included. The walls 174, 175 divide the decks 104, 106 into first and second sections 176, 177 that extend between the inlet and outlet ends 152, 154. The pair 126 of interior walls 174, 175 depend longitudinally between the inlet end 152 and the outlet end 154 in a fashion similar to the sidewalls 162, 164. The walls 174, 175 are also disposed laterally between the first and second sidewalls 162, 164. That is, the walls 174, 175 are disposed at a distance along an axis orthogonal to the axis 150 between the first and second sidewalls 162, 164. As illustrated, the walls 174, 175 are disposed approximately at the midpoint of the lateral axis relative to the first and second sidewalls 162, 164 (compare FIGS. 1 and 3).

In fact, the decks 104, 106 each may be divided into first and second subdecks, the first subdecks defining the first section 176 and the second subdecks defining the second section 177. As best seen in FIG. 1, the first subdecks (of the first section 176) are attached at first edges 166, 170 to the side wall 162 and at second edges 178, 179 to the interior wall 174. The second subdecks (of the second section 177) are attached at first edges 168, 172 to the side wall 164 and at second edges 180, 181 to the interior wall 175. The first and second sections 176, 177 may be referred to as the left and right hand sections, as observed from the outlet end 154 (see FIGS. 1 and 3).

The walls 174, 175 include surfaces 182, 183. The surface 183 is illustrated in FIG. 1, while the surface 182 is illustrated in FIG. 2. The surfaces 182, 183 are disposed such that the surfaces 182, 183 face each other, as illustrated in FIGS. 1 and 2, for purposes of assembly. According to one method of assembly, the surfaces 182, 183 are disposed such that the surfaces 182, 183 abut, at least in part, and then the walls 174, 175 are reversibly attached to each other, for example through the use of fasteners, such as nut-bolt pairs. Such a method of assembly is useful, for example, when assembling the apparatus 100 for purposes of testing and calibration at the fabrication site, so that the apparatus 100 may be disassembled into sections 120, 122, 124 for transportation. According to another method of assembly, the surfaces 182, 183 are disposed such that the surfaces 182, 183 abut, at least in part, and then the walls 174, 175 are irreversibly attached to each other, for example by welding the walls 174, 175 together. The walls 174, 175 are described as "irreversibly" attached to mean that the walls 174, 175 cannot be separated without use of cutting tools or the like.

As illustrated, the deck 104 is disposed above the deck 106, and may have at least a first region that has a plurality of apertures or holes formed therethrough or that is defined by a mesh or other material having openings therethrough. This region of the deck 104 may also be referred to as foraminous, and the deck 104 may be referred to as a foraminous deck. Material that is larger than the apertures may pass along the deck 104 from the inlet end 152 to the outlet end 154, while material that is smaller than the apertures may fall through the deck 104 and be deposited on the deck 106. The material passing through the deck 104 may then pass along the deck 106 to the outlet end 154, although it is also possible for the deck 106 to have apertures or holes formed therethrough, or to be defined by a mesh or other material having openings therethrough. Where the deck 106 is the lowermost deck of the trough 160, the deck 106 may also be referred to as the floor of the trough 160.

The deck 104 may also have an initial region 190 that is does not have any apertures, holes, etc. This initial region 190 may be used to initially receive the material that will be passed over the decks 104, 106. The initial region 190 may be inclined relative to the remainder of the deck 104 so as to encourage the material disposed on the region 190 to move from the region 190 to the remainder of the deck 104.

The decks 104, 106 may have a liner disposed on an upwardly-facing transporting surface thereof. The liner may include multiple plates, and may define, at least in part, the openings or apertures that pass through the deck 104, for example. In one exemplary embodiment, the liner may be used to increase the resistance of the decks 104, 106 to wear.

The trough 160 may also include one or more crossbeams that are attached to and depend between the sidewalls 162, 164. More particularly, the crossbeams may be attached to and depend between one of the sidewalls 162, 164 and the interior walls 174, 175. According to certain embodiments, there may be two pairs of crossbeams adjacent the inlet end 152 (with a first crossbeam of each pair depending between the sidewall 162 and interior wall 174 and a second crossbeam of each pair depending between the sidewall 164 and the interior wall 175), and a further pair at the outlet end 154 (again with a first crossbeam of the pair depending between the sidewall 162 and interior wall 174 and a second crossbeam of the pair depending between the sidewall 164 and the interior wall 175). The crossbeams may be spaced from the surface of the deck 104 so as to permit material to freely move along the surface of the deck 104.

The trough 160 may further include one or more mounting brackets 200, 202, 204, 206. The mounting brackets 200, 204 may be joined or attached to an outer surface of the side wall 162 (FIGS. 1 and 3), while the mounting brackets 202, 206 are joined or attached to an outer surface of the side wall 164 (FIG. 2). The isolation springs 110 are attached at a first end to one of the mounting brackets 200, 202, 204, 206 and at a second end to the frame 112.

As mentioned above, the apparatus 100 also includes the exciter 114. The exciter 114 may be coupled to the trough 160 (and the decks 104, 106) via reactor springs 118, links (not shown) and brackets 210, which brackets 210 may depend between the sidewalls 162, 164 and the at least one pair of mated interior walls 126, as illustrated. Accordingly, the exciter 114 may be described as attached to the first and second sidewalls or sides 162, 164 and at least one pair of mated interior walls 126 of the trough 160. The details of the exciter 114 are now discussed with reference first to FIG. 4.

The exciter 114 includes a frame with first and second side walls 220, 222 parallel to the longitudinal axis 150. As illustrated, the exciter 114 also includes three crossbeams 224, 226, 228 that are connected at opposite ends to an inner surface of the side walls 220, 222, although the exciter may have a smaller or a larger number of crossbeams according to other embodiments. As also illustrated, the exciter 114 includes two motor mounts 230, 232 that are attached to the crossbeams 224, 226, 228, although again the number of motors (and thus the number of motor mounts) may vary with certain embodiments having anywhere from one to four motors (and motor mounts). As illustrated, the motor mount 230 is attached to and depends between the crossbeams 224, 226, and the motor mount 232 is attached to and depends between the crossbeams 226, 228. The motor mounts 230, 232 are attached to and depend between the crossbeams 224, 226, 228 at the midpoints of the crossbeams 224, 226, 228 (i.e., along the longitudinal axis 150 of the apparatus 100).

Figure 4:
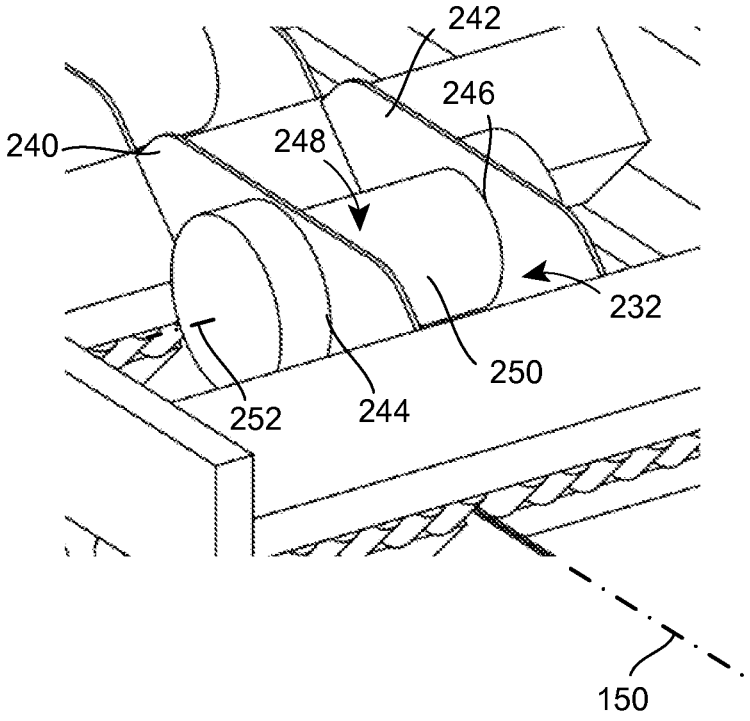
FIG. 4 is an enlarged, perspective view of a portion of the exciter of the apparatus of FIGS. 1-3.

The details of the motor mounts 230, 232 are now explained with reference to the motor mount 232 and FIG. 4, although a similar explanation would be applicable to the motor mount 230. The motor mount 232 includes first and second mounting plates 240, 242, each of which includes an opening 244, 246 for a motor assembly 248. The motor assembly 248 includes a motor 250 with a shaft disposed along an axis 252. The axis 252 of the motor 250 intersects the axis 150 of the apparatus 100 at an angle as viewed from above; as illustrated, the axes 150, 252 intersect at a right angle (i.e., the axes are orthogonal; the axis 252 may also be described as transverse to the longitudinal axis 150). A pair of eccentric weights is attached at either end of the motor shaft, and rotates about the axis 252.

As mentioned previously, the exciter 114 (or more particularly, the side walls 220, 222 and crossbeams 224, 226, 228 of the exciter 114) may be coupled to the decks 104, 106 (or more particularly, attached to the side walls 162, 164 and at least one pair of mated interior walls 126 of the trough 160) via the reactor springs 118, links (not shown) and brackets 210. According to certain embodiments, the springs 118 and links may be grouped into pairs, with each pair of springs 118 and links inclined at opposing angles to the horizontal (for example, the links may form an obtuse angle with the horizontal, while the paired springs 118 may form an acute angle with the horizontal). In particular, the links may be attached at a first end to the exciter 114 and a second end to the trough 160, such that the first side 162 is attached to the first side 220 and the second side 164 is attached to the second side 222 via the links.

A method of transporting and assembling the vibratory apparatus 100 includes fabricating, at a fabrication site, the first sidewall 162, a second sidewall 164 and at least one pair of mated interior walls 126, the first sidewall 162, the second sidewall 164 and the at least one pair of mated interior walls 126 depending longitudinally between the inlet end 152 and the outlet end 154. The at least one pair of mated interior walls 126 is disposed laterally between the first and second sidewalls 162, 164 when the apparatus 100 is assembled, and at least one deck 104, 106 depending between the first and second sidewalls 162, 164 when the apparatus 100 is assembled, and divided into longitudinally depending sections 176, 178 by the at least one pair of mated interior walls 126. The method also includes fabricating at a fabrication site an exciter 114 to be coupled to the at least one deck 104, 106. The method further includes transporting the apparatus 100 in at least three sections 120, 122, 124 to an installation site: (i) the first section 120 comprising the first sidewall 162, one of the at least one pair of mated interior walls, and the longitudinally depending sections 176 of the at least one deck 104, 106 between the first sidewall 162 and the one of the at least one pair of mated interior walls, (ii) the second section 122 comprising the second sidewall 164, one of the at least one pair of mated interior walls, and the longitudinally depending sections 178 of the at least one deck 104, 106 between the second sidewall 164 and the one of the at least one pair of mated interior walls, and (iii) the third section 124 comprising the exciter 114. In addition, the method includes attaching the pair of mated interior walls 126 together at the installation site, and attaching the exciter 114 to the first and second sections 120, 122 at the installation site.

As mentioned above, attaching the pair of mated interior walls 126 together at the installation site may include irreversibly attaching the pair of interior walls 126, by welding the pair 126 together, for example. As also referenced above, the pair of mated interior walls 126 may include a first interior wall 174 and a second interior wall 175, each of the first and second interior walls 174, 175 having a surface 182, 183, and attaching the pair of mated interior walls 126 together at the installation site may include disposing the surfaces 182, 183 of the first and second interior walls 174, 175 facing each other and abutting, at least in part, each other.

Furthermore, the method may include reversibly attaching the pair of mated interior walls 126 together at the fabrication site, such as by securing the interior walls together using fasteners, for example. Again, where the pair of mated interior walls 126 includes a first interior wall 174 and a second interior wall 175, each of the first and second interior walls 174, 175 having a surface 182, 183, attaching the pair of mated interior walls together at the fabrication site may include disposing the surfaces 182, 183 of the first and second interior walls 174, 175 facing each other and abutting, at least in part, each other.

Operation of the apparatus 100 thus transported and assembled may include operation of the two-mass, subresonant frequency exciter 114, which in turn may include operating at least one motor 250 mounted on the exciter 114, the motor 250 having a motor axis 252 transverse to a longitudinal axis 150 of the trough 160, which axis 150 extends between an inlet end 152 and an outlet end 154 of the trough 160, the motor 250 coupled to the trough 160 through at least one reactor spring 118. Alternatively or in addition, the motor 250 may be coupled to the trough 160 through at least one reactor spring 118 and (optionally) at least one link. Operation of the apparatus 100 also may include depositing a material (such as rock or ore) on the upper foraminous deck 104 of the trough 160 at the inlet end 152 of the trough 160. According to such an embodiment, the method may also include separating the material into a first class that passes over the deck 104 between the inlet end 152 and an outlet end 154, and a second class that passes through the deck 104 with the exciter 114 operating.

Although the preceding text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

What is claimed is:

1. A vibratory apparatus comprising:

a first sidewall, a second sidewall and at least one pair of mated interior walls, the first sidewall, the second sidewall and the at least one pair of mated interior walls depending longitudinally between an inlet end and an outlet end, the at least one pair of mated interior walls disposed laterally between the first and second sidewalls, the at least one pair of mated interior walls being attached to each other;

at least one deck depending between the first and second sidewalls, and divided into longitudinally depending sections by the at least one pair of mated interior walls; and an exciter coupled to the at least one deck.

2. The vibratory apparatus according to claim 1, wherein:

the pair of mated interior walls includes a first interior wall and a second interior wall, each of the first and second interior walls having a surface that faces the surface of the other of the first and second interior walls and abuts, at least in part, the surface of the other of the first and second interior walls.

3. The vibratory apparatus according to claim 1, wherein the first and second interior walls are reversibly attached to each other.

4. The vibratory apparatus according to claim 1, wherein the first and second interior walls are irreversibly attached to each other.

5. A method of assembling a vibratory apparatus, comprising:

fabricating at a fabrication site a first sidewall, a second sidewall and at least one pair of mated interior walls, the first sidewall, the second sidewall and the at least one pair of mated interior walls depending longitudinally between an inlet end and an outlet end, the at least one pair of mated interior walls disposed laterally between the first and second sidewalls when the apparatus is assembled, and at least one deck depending between the first and second sidewalls when the apparatus is assembled, and divided into longitudinally depending sections by the at least one pair of mated interior walls;

fabricating at a fabrication site an exciter to be coupled to the at least one deck;

transporting the apparatus in at least three sections to an installation site, the first section comprising the first sidewall, one of the at least one pair of mated interior walls, and the longitudinally depending section of the at least one deck between the first sidewall and the one of the at least one pair of mated interior walls, the second section comprising the second sidewall, one of the at least one pair of mated interior walls, and the longitudinally depending section of the at least one deck between the second sidewall and the one of the at least one pair of mated interior walls, and the third section comprising the exciter;

attaching the pair of mated interior walls together at the installation site; and attaching the exciter to the first and second sections at the installation site.

6. method according to claim 5, wherein attaching the pair of mated interior walls together at the installation site comprises irreversibly attaching the pair of mated interior walls together at the installation site.

7. The method according to claim 6, wherein irreversibly attaching the pair of mated interior walls together at the installation site comprises welding the interior walls together.

8. The method according to claim 6, wherein:

the pair of mated interior walls includes a first interior wall and a second interior wall, each of the first and second interior walls having a surface, and attaching the pair of mated interior walls together at the installation site comprises disposing the surfaces of the first and second interior walls facing each other and abutting, at least in part, each other.

9. The method according to claim 5, further comprising reversibly attaching the pair of mated interior walls together at the fabrication site.

10. The method according to claim 9, wherein reversibly attaching the pair of mated interior walls together at the fabrication site comprises securing the interior walls together using fasteners.

11. The method according to claim 10, wherein:

the pair of mated interior walls includes a first interior wall and a second interior wall, each of the first and second interior walls having a surface, and attaching the pair of mated interior walls together at the fabrication site comprises disposing the surfaces of the first and second interior walls facing each other and abutting, at least in part, each other.

* * * * *